US008387908B2

(12) United States Patent
Van Veen et al.

(10) Patent No.: US 8,387,908 B2
(45) Date of Patent: Mar. 5, 2013

(54) FEEDING STATION FOR A PRINTING PRESS, CORRESPONDING PRINTING PRESS AND METHOD

(75) Inventors: Roeland Van Veen, Den Bosch (NL); Kees Bastiaans, Boxmeer (NL)

(73) Assignee: Goss Contiweb B.V., Boxmeer (NL)

( * ) Notice: Subject to any disclaimer, the term of this patent is extended or adjusted under 35 U.S.C. 154(b) by 142 days.

(21) Appl. No.: 12/465,454

(22) Filed: May 13, 2009

(65) Prior Publication Data

US 2009/0283622 A1 Nov. 19, 2009

(30) Foreign Application Priority Data

May 13, 2008 (EP) ..... 08300201

(51) Int. Cl.
*B65H 19/00* (2006.01)

(52) U.S. Cl. ..... 242/559; 242/559.3; 242/559.4

(58) Field of Classification Search ..... 242/559, 242/559.1, 559.3–559.4; 414/911
See application file for complete search history.

(56) References Cited

U.S. PATENT DOCUMENTS

| | | | | |
|---|---|---|---|---|
| 6,039,284 | A | 3/2000 | Lehrrieder et al. | 242/559 |
| 7,661,243 | B2 * | 2/2010 | Lindberg | 53/167 |
| 7,703,259 | B2 * | 4/2010 | Lindberg | 53/167 |
| 2002/0130214 | A1 | 9/2002 | Nakamura et al. | 242/559 |
| 2004/0056140 | A1 | 3/2004 | Brandli et al. | 242/559.2 |
| 2005/0023408 | A1 * | 2/2005 | Brandli et al. | 242/559.2 |
| 2006/0000940 | A1 | 1/2006 | Frey et al. | 242/559.3 |
| 2006/0049296 | A1 * | 3/2006 | Bucher et al. | 242/559.4 |

FOREIGN PATENT DOCUMENTS

| | | | |
|---|---|---|---|
| DE | 43 44 743 | A1 | 6/1995 |
| DE | 196 37 771 | A1 | 3/1998 |
| DE | 196 51 205 | A1 | 6/1998 |
| DE | 198 60 475 | A1 | 7/2000 |
| DE | 10 2004 021605 | A1 | 9/2005 |
| EP | 1 044 912 | A | 10/2000 |
| EP | 1 400 472 | A | 3/2004 |
| EP | 1 612 169 | A | 1/2006 |
| WO | WO 95/20537 | A | 8/1995 |

* cited by examiner

*Primary Examiner* — Sang Kim
(74) *Attorney, Agent, or Firm* — Davidson, Davidson & Kappel, LLC

(57) ABSTRACT

A feeding station for a splicer of a rotary offset printing press is provided. The feeding station includes a feeding device for feeding a paper roll into a splicer; an unpack station for unpacking a paper roll; and a buffer station for storing an unpacked paper roll.
The feeding station includes an unpack conveyor leading from the unpack station to the feeding device; and a buffer conveyor leading from the buffer station to the feeding device. The feeding device includes a feeding carriage having a core container for holding two or more cores.
A corresponding method is also provided.

18 Claims, 5 Drawing Sheets

FEEDING STATION FOR A PRINTING PRESS, CORRESPONDING PRINTING PRESS AND METHOD

Priority is claimed to European Patent Application No. 08300201.4, filed on May 13, 2008, and hereby incorporated by reference herein.

BACKGROUND

The present patent application concerns a feeding station for a splicer of a rotary offset printing press, of the type including a feeding device for feeding a paper reel into a splicer, an unpack station for unpacking a paper reel and a first buffer station for storing an unpacked and prepared paper reel.

Known feeding stations include an unpack station for unpacking a paper reel, a buffer station for buffering the unpacked reel and a feeding device for feeding a paper reel into the splicer. Splicers are also called "pasters" or "reel changers". In the following the term "splicer" is used synonymously for pasters and reel changers.

In the known devices, a track leads from the unpacking station directly to the buffer station and directly from the buffer station to the feeding device.

The buffer station is necessary, as unpacking the reel takes usually longer than feeding it into the splicer. Hence, when a new reel needs to be fed into the splicer, the new reel must already be unpacked and prepared.

Also, the used reels are usually taken off the splicer one by one and disposed of immediately. This operation is cumbersome.

The known layout of the feeding device takes up a great amount of space.

SUMMARY OF THE INVENTION

The present invention seeks to improve the layout, in particular so as to be more compact, in particular narrower, or so as to become more efficient in use.

The present invention provides a feeding station including a core container and the feeding carriage includes a core container support adapted to hold the core container, the core container is adapted to hold at least two residual reels or reel cores, and the core container support is arranged offset with respect to the reel support.

According to preferred, specific embodiments, the feeding station may include one or more of the following features:

- an unpack conveying means leading from the unpack station to the feeding device; and
- a first buffer conveying means leading from the first buffer station to the feeding device; wherein the feeding carriage is mobile between:
- a feeding position, in which the reel support is adapted to feed a new paper reel to a splicer;
- an unpack position, in which the reel support is adapted to be loaded with a prepared paper reel from the unpack conveying means; and
- a first buffer position in which the reel support is adapted to unload a prepared paper reel to the first buffer conveying means or to receive a prepared paper reel from the first buffer conveying means;
- the first buffer conveying means and the first buffer station are arranged, preferably exclusively, on a side of the feeding device opposite the side of the unpack station and the unpack conveying means;

- the unpack position and the first buffer position are identical and a prepared paper reel is conveyable from the unpack conveying means to the reel support and further from the reel support to the first buffer conveying means without moving the feeding carriage;
- the feeding station comprises a second buffer station, and second buffer conveying means leading from the second buffer station to the feeding device arranged, preferably exclusively, on the same side of the feeding device as the unpack station;
- the feeding station comprises a third buffer station and third buffer conveying means leading from the third buffer station to the feeding device arranged, preferably and exclusively, on the same side of the feeding device as the first buffer station;
- the feeding carriage is further mobile between second and/or third buffer position(s) in which the reel support is adapted to unload an unpacked paper reel to the second and/or third buffer conveying means or to receive a buffered paper reel from the second and/or third buffer conveying means, and in that the unpack position is different from the second and/or third buffer position(s);
- the second and third buffer positions are identical;
- the feeding carriage comprises an auxiliary support adapted to hold a residual reel;
- the auxiliary support is constituted by the core container support and is adapted to hold a residual reel when the core container is not held by the core container support;
- at least one of the conveying means and preferably each of the conveying means comprise track means leading from the corresponding station to the feeding device;
- the feeding carriage has a base and in that the reel support is pivotable with respect to the base around a vertical axis; and
- the pivot angle of the reel support is at least 45°, preferably at least 90°, 180° or 270°.

The invention also provides a rotary printing press including a reel splicer and a feeding station adapted to feed paper reels to the reel splicer, characterized in that the feed station is a feed station as indicated above.

The invention also provides use of a feeding station as indicated above, comprising the following successive steps:

a) providing a first packed reel to the unpack station, b) unpacking the first packed reel at the unpack station, c) transferring the first unpacked reel to the first buffer station, d) providing a second packed reel to the unpack station, e) unpacking the second packed reel at the unpack station, f) transferring the first unpacked reel from the first buffer station to the splicer, and g) feeding the first unpacked reel to the splicer.

According to a specific embodiment, the use of the feeding station includes the feature according to which step f) is executed while step e) is executed.

BRIEF DESCRIPTION OF THE DRAWINGS

The invention will be explained with reference to the annexed drawings, which show.

DETAILED DESCRIPTION OF THE PREFERRED EMBODIMENTS

Figure 1:
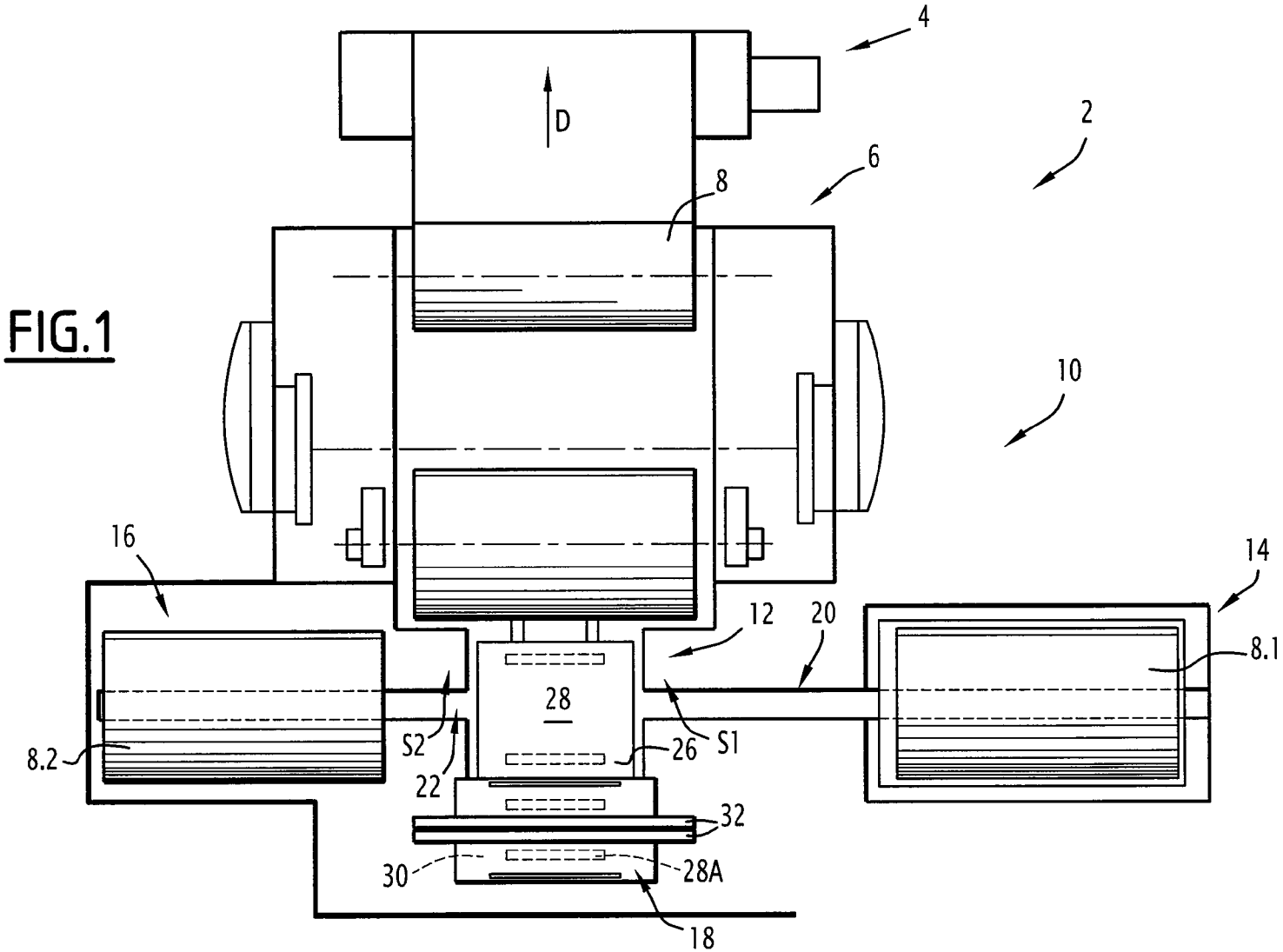
FIG. 1 is a plan view of a printing press having a feeding station according to a first embodiment of the invention.

FIG. 1 shows a plan view of a rotary offset printing press, designated by the general reference number 2.

The printing press 2 includes one or several print units 4 adapted to print on a paper web, and a splicer 6 adapted to provide the print unit 4 with a paper web.

To this end, the splicer 6 carries one current paper reel 8 feeding the print unit 4 in a paper travel direction D. In the following, the expressions "laterally" and "lateral direction" will be used with reference to the paper travel direction D, "laterally" meaning horizontal and perpendicular to the paper travel direction D. The lateral direction is indicated as "L" in FIG. 2. The expression "width" will be measured along the lateral direction.

While the current paper reel 8 is feeding the print units, a new paper reel needs to be loaded to the splicer 6.

To this end, the printing press includes a feeding station 10.

The feeding station 10 includes a feeding device 12 adapted to feed a new paper roll into the splicer 6. The feeding station 10 includes also an unpack station 14, a first buffer station 16 and a core container 18.

The feeding station 10 includes unpack conveying means, for example, unpack conveyor 20, leading from the unpack station 14 to the feeding device 12 and first buffer conveying means, for example, first buffer conveyor 22 leading from the feeding device to the first buffer station 16.

The unpack 14 station receives a new packed paper reel 8.1. The packed paper reel 8.1 is unpacked at this station and prepared. A prepared paper reel has no package and includes an adhesive tape at the beginning of its web.

A prepared reel 8.2 is buffered at the buffer station 16.

The paper reel 8.1 has a maximum nominal width NW corresponding to its axial length.

The unpack station 14 and the unpack conveyor 20 are arranged on a first lateral side S1 of the feeding device 12 and the unpack conveyor 20 is connected to the feeding device 12 on said first side S1.

The first buffer station 16 and the first buffer conveyor 22 are arranged on a second lateral side S2 of the feeding device 12, opposite the first lateral side S1. The first buffer conveyor 22 is connected to the feeding device 12 on the second side S2. The first buffer station 16 forms a dead end of the first buffer conveyor 22.

The first buffer station 16 has a length LB, measured in the lateral direction L and overlaps in the lateral direction the splicer 6, hence contributing to a compact layout.

The feeding device 12 has a feeding carriage 26 having a reel support 28 adapted to carry a new unpacked and prepared reel 8.2 to be loaded into the splicer 6.

The feeding carriage 26 also includes a core container support 30 onto which is placed the core container 18. The core container support 30 is arranged behind the reel support 28 offset in the paper travel direction D. The core container 18 contains one or more cores or residual reels 32 having a diameter inferior to the diameter of the new prepared reels 8.2.

The feeding carriage 26 includes also an auxiliary support 28A adapted to hold a residual reel. The auxiliary support 28A is preferably adapted to hold one single residual reel. The residual reel can have a diameter of half the diameter of a new reel.

The auxiliary support 28A is arranged at the same place of the feeding carriage 26 as the core container support 30.

Therefore, the feeding carriage 26 can either carry the core container 18 or receive a residual reel on the auxiliary support 28A.

When the paper web jams in the splicer 6 and the current reel 8 has a large diameter, then the core container 18 is retracted from the feeding carriage 26, the feeding carriage 26 is moved into the splicer 6 and the current reel 8 is taken as residual reel by the auxiliary support 28A.

The feeding carriage 26 is mobile, along the paper web travel direction D, between a feeding position, in which a new paper reel 8.2 positioned on the reel support 28 can be fed into the splicer 6, and an unpack/first buffer position.

In FIG. 1, the unpack/first buffer position is shown. The feeding position is located forward in the paper travel direction D from the shown position.

The unpack conveyor 20 and the first buffer conveyor 22 are connected to the feeding device 12 at the same position, seen in the paper travel direction D. The reel support 28 is therefore connected simultaneously to the unpack conveyor 20 and to the first buffer conveyor 22 when the feeding carriage 26 is in the unpack/first buffer position. In this position, the reel support 28 is adapted to be loaded with an unpacked paper reel 8.1 from the unpack station 14 and to unload this unpacked paper reel to the first buffer conveyor 22. Also, in this position, the reel support 28 is adapted to receive a prepared and buffered new paper reel 8.2 from the buffer conveyor 22.

In other terms, the prepared paper reel 8.2 is conveyable from the unpacking conveyor 20 to the first buffer conveyor 22 without moving the feeding carriage 26.

The feeding station 10 is operated as follows:

Firstly, a first packed new reel 8.1 is provided to the unpack station 14.

Secondly, the first packed new reel 8.1 is unpacked at the unpack station 14 and prepared with an adhesive ribbon becoming a prepared new reel 8.2.

Thirdly, the first prepared new reel 8.2 is transferred to the first buffer station 16, the carriage 26 being in its unpack/first buffer position.

Fourthly, a second packed new reel 8.1 is provided to the unpack station 14, while the first prepared reel 8.2 is transferred to the first buffer station 16 or while it waits in the buffer station.

Fifthly, the second packed reel 8.1 is unpacked and prepared at the unpack station 14 becoming a second prepared new reel 8.2.

Finally, the first prepared reel 8.2 is transferred from the first buffer station 16 to the feeding carriage 26 and is then the fed to the splicer 6.

The used core or the residual roll 32 in the splicer 6 is dropped into the core container 18. The position of the carriage 26 during dropping off the core/used reel 32 can be the same as during loading the new prepared reel into the splicer.

During several reel changes, the reel cores or the residual reels 32 stay in the core container 18. When the core container 18 is full, it contains two or more cores or residual reels 32. The core container 18 is then taken by an operator and disposed of and an empty core container 18 is put onto the support 30. The core/residual reel 32 does therefore not need to be retracted from the feeding carriage 26 after each cycle, but only after more than one cycle. This feature increases ease of operation.

Also, the core container 18 being arranged on the feeding carriage 26 means that it is close to the unpack station 14.

Hence, the travel distance for a forklift loading a new reel 8.1 onto the unpack station 14 and picking up the core container 18 is short.

Figure 3:
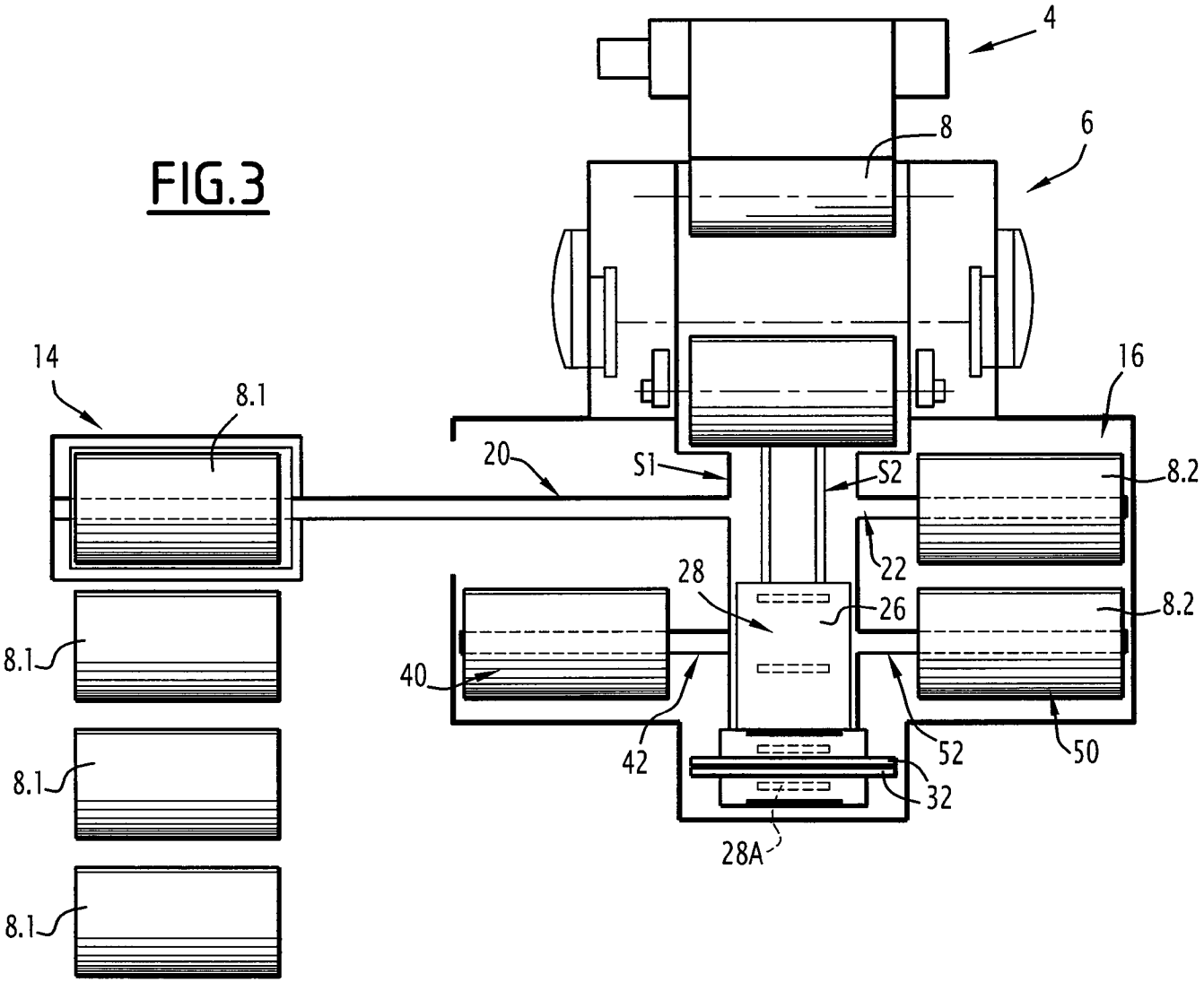
FIGS. 3 and 4 are plan views of a printing press including second and third embodiments of the feeding station according to the invention.

FIG. 3 shows a printing press having a second embodiment of the feeding station. The feeding station differs from the preceding feeding station in the following aspects. Analogous features have the same references.

Figure 2:
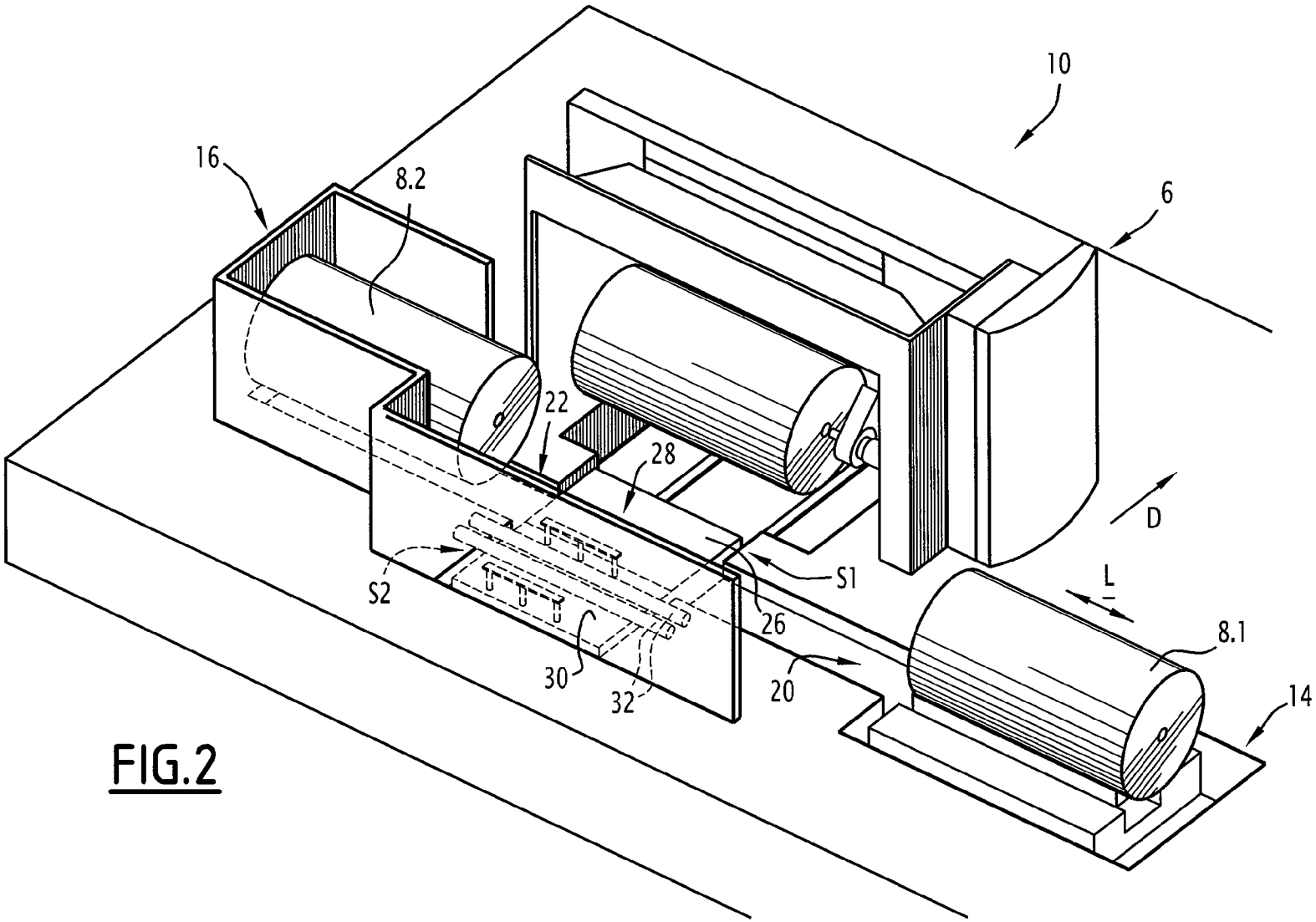
FIG. 2 is a perspective view of the feeding station of FIG. 1.

The layout is inversed with respect to the one of FIGS. 1 and 2. Hence, the first lateral side S1 is on the left side of FIG. 3 and the second lateral side S2 is on the right side of FIG. 3.

Furthermore, the feeding station 10 includes a second buffer station 40 and second buffer conveying means, for example, second buffer conveyor 42 leading from the second buffer station 40 to the feeding device 12.

The second buffer station 40 is arranged on the same lateral side S1 of the feeding device 12 as the unpack station 14, and the second buffer conveyor 42 is connected to the feeding device 12 at the same first lateral side S1.

The second buffer station 40 is offset with respect to the unpack station 14 in the paper travel direction D and is further away from the splicer 6 than the unpack station 14.

The second buffer station 40 has a length LB, measured in the lateral direction, and overlaps in the lateral direction the splicer 6, hence contributing to a compact layout.

The feeding carriage 26 is identical to the feeding carriage of the first embodiment and has a support 30 for the core container 18.

The feeding station 10 includes, a third buffer station 50 for buffering a third unpacked 8.2 paper reel. Furthermore, third buffer conveyor means, for example, third buffer conveyor 52 are leading from the third buffer station 50 to the feeding device 12. Accordingly, the feeding carriage 26 has a third buffer position which allows transferring a paper reel 8.2 between the reel support 28 and the third buffer station. In the present case, the third buffer position is, for example, identical to the second buffer position.

This feeding station has a large amount of buffer capacity and allows freeing the operator for a large amount of time once the three buffers stations 16, 40, 50 are loaded with unpacked paper reels. Also, all of the buffer stations overlap laterally with the splicer 6. Hence, this layout may be particularly compact.

The third buffer station 50 is arranged on the second lateral side S2 of the feeding device 12 and is aligned in the paper travel direction D with the second buffer station 40.

The operation thereof is as follows:

A new packed reel 8.1 is provided at the unpack station 14 and is unpacked and prepared, thus obtaining a first prepared reel 8.2.

The first prepared reel 8.2 is then transferred to the first buffer station 16 via the unpack conveyor 20 and the first buffer conveyor 22.

Then, a second packed reel 8.1 is provided to the unpack station 14 and unpacked and prepared. This second prepared reel 8.2 is transferred to the second buffer station 40. Then a third packed reel 8.1 is provided to the unpack station 14 and unpacked and prepared.

As soon as the reel splicer 6 has finished a reel 8, the feeding carriage 26 moves with the core container into the pick-up position. The reel core or the residual reel 32 drops from the splicer 6 into the container 18.

Then a new prepared reel 8.2 is transferred from one of the buffer stations 16, 40 to the reel support 28. The feeding carriage moves into its feeding position and the new prepared reel 8.2 is fed into the splicer.

Figure 4:
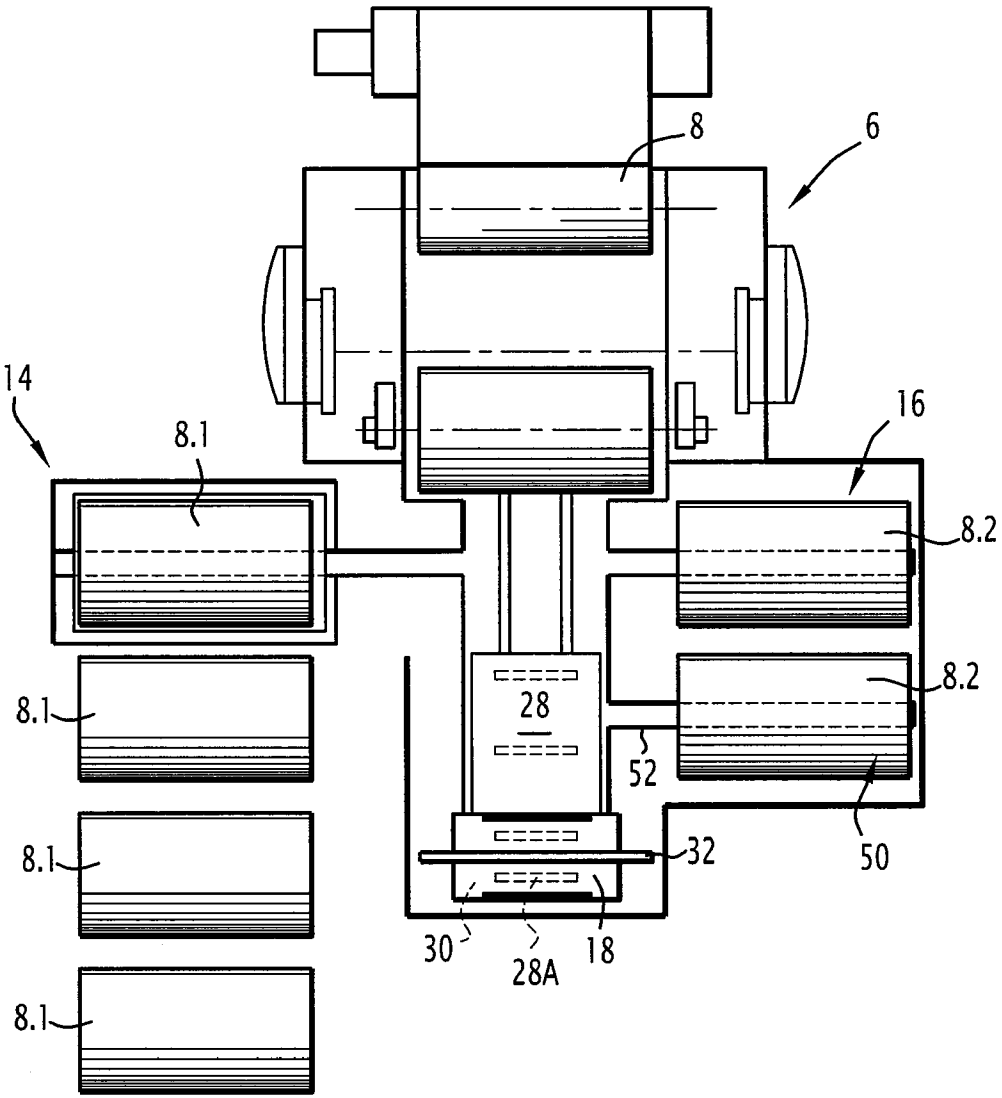

FIG. 4 shows a printing press having a third embodiment of the feeding station 10.

This feeding station differs from the second embodiment in the following features.

The second buffer station 40 and the corresponding second conveyor 42 have been omitted.

Consequently, the unpack station 14 is positioned closer to the splicer 6. Preferably, the unpack station 14 overlaps the splicer 6 in the lateral direction thus having a narrow width.

Operation of this feeding station is analogous to the operation of the second embodiment.

The following features apply advantageously to all of the above embodiments.

Preferably, the length CL of at least one of the conveying means 20, 22, 42, 52 or the length CL of each of the conveying means is inferior to a nominal width NW of the paper reels. The length is measured from the corresponding station 14, 16, 40 to the feeding device 12.

Preferably, at least one of the conveyors 20, 22, 42, 52, and in particular all of them, define straight paths from the corresponding station 14, 16, 40, 50 to the feeding device 12.

Also, the conveying means may include tracks leading to and from the corresponding stations, the reels or the core container, where applicable, being transported by carriages. Alternatively, the conveying means may include grooves in which carriages run. This alternative is depicted in FIG. 2. Again alternatively, the conveying means may include conveyor belts running from the corresponding stations to the feeding carriage 26, the reel support 28 having also a conveyor belt allowing transferring the reel and/or the core container 18.

The layout according to the invention may be particularly compact for a given buffer capacity.

The layout may allow for freeing the operator for a long time between loading cycles and may provide an easy access to the core container.

Figure 5:
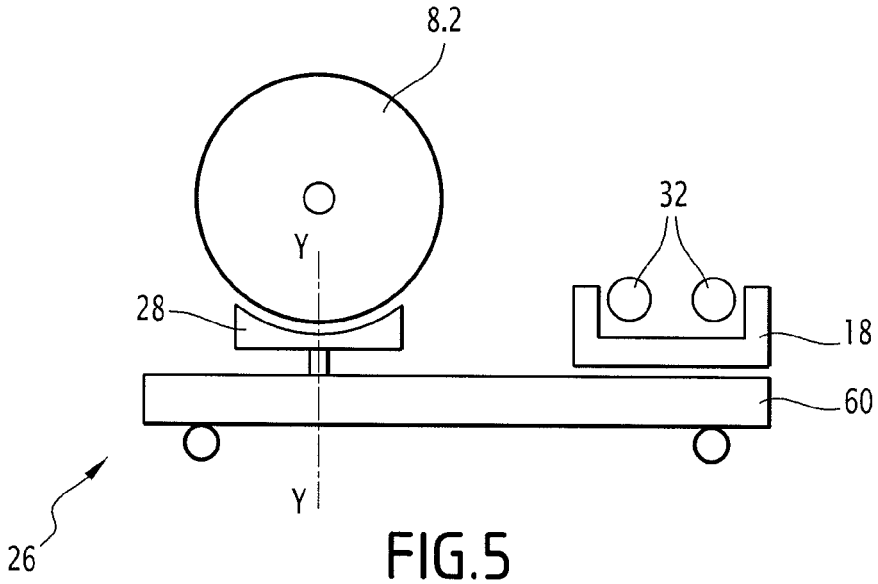
FIG. 5 schematically shows a reel support pivotable with respect to a base of a feeding carriage around a pivot axis extending vertically.

According to an alternative embodiment schematically shown in FIG. 5, the reel support 28 is pivotable with respect to a base 60 of the feeding carriage 26 around a pivot axis Y extending vertically. The pivot angle around the pivot axis is preferably at least 45° and may preferably be 90°, 180° or 270°.

According to another variant, a turntable is arranged in the path from the unpack station 14 to pivot a prepared paper reel around at least 45°, preferably around 90°.

According to a non represented variant, the first buffer conveying means and the first buffer station are arranged on the same side of the feeding device as the unpack station and the unpack conveying means.

What is claimed is:

1. A feeding station for a splicer of a rotary offset printing press comprising:

a feeding device for feeding a paper reel into a splicer, the feeding device including a feeding carriage having a reel support supporting a new prepared paper reel;

an unpack station for unpacking a paper reel;

a first buffer station for storing an unpacked and prepared paper reel;

a core container holding at least two residual reels or reel cores;

an unpack conveyor leading from the unpack station to the feeding device; and a first buffer conveyor leading from the first buffer station to the feeding device;

the feeding carriage including a core container support holding the core container, the core container support arranged offset with respect to the reel support;

the feeding carriage being mobile between:

a feeding position, in which the reel support is adapted to feed a new paper reel to the splicer;

an unpack position, in which the reel support is adapted to be loaded with a prepared paper reel from the unpack conveyor; and a first buffer position in which the reel support is adapted to unload a prepared paper reel to the first buffer conveyor or to receive a prepared paper reel from the first buffer conveyor;

wherein the feeding carriage includes a base, the reel support being pivotable with respect to the base around a vertical axis of reel support.

2. The feeding station according to claim 1 wherein the first buffer conveyor and the first buffer station are arranged on a side of the feeding device opposite the side of the unpack station and the unpack conveyor.

3. The feeding station according to claim 1 wherein the unpack position and the first buffer position are the same position and a prepared paper reel is conveyable from the unpack conveyor to the reel support and further from the reel support to the first buffer conveyor without moving the feeding carriage.

4. The feeding station according to claim 1 further comprising a second buffer station and a second buffer conveyor leading from the second buffer station to the feeding device, the second buffer station arranged, on the same side of the feeding device as the unpack station.

5. The feeding station according to claim 4 wherein the feeding station includes a third buffer station and third buffer conveyor leading from the third buffer station to the feeding device arranged on the same side of the feeding device as the first buffer station.

6. The feeding station according to claim 5 wherein the feeding carriage is further mobile between a second or a third buffer position in which the reel support is adapted to unload an unpacked paper reel to the second or third buffer conveyor or to receive a buffered paper reel from the second or third buffer conveyor, respectively, the unpack position being different from the second or third buffer positions.

7. The feeding station according to claim 6 wherein the second and third buffer positions are the same position.

8. The feeding station according to claim 1 wherein the feeding station includes a third buffer station and third buffer conveyor leading from the third buffer station to the feeding device arranged on the same side of the feeding device as the first buffer station.

9. The feeding station according to claim 1 wherein the feeding carriage includes an auxiliary support adapted to hold a residual reel.

10. The feeding station according to claim 9 wherein the auxiliary support includes the core container support and is adapted to hold a residual reel when the core container is not held by the core container support.

11. The feeding station according to claim 1 wherein at least one of the conveyors includes a track leading from the corresponding station to the feeding device.

12. The feeding station according to claim 1 wherein the reel support is pivotable with respect to the base around the vertical axis at a pivot angle of at least 45°.

13. The feeding station according to claim 1 wherein the reel support is pivotable with respect to the base around the vertical axis at a pivot angle of at least 90°.

14. The feeding station according to claim 1 wherein the reel support is pivotable with respect to the base around the vertical axis at a pivot angle of at least 180°.

15. The feeding station according to claim 1 wherein the reel support is pivotable with respect to the base around the vertical axis at a pivot angle of at least 270°.

16. A rotary printing press comprising:

a reel splicer; and a feeding station adapted to feed paper reels to the reel splicer;

wherein the feed station is a feed station according to claim 1.

17. A method for operating the feeding station according to claim 1, the method comprising the following successive steps:

a) providing a first packed reel to the unpack station;

b) unpacking the first packed reel at the unpack station;

c) transferring the first unpacked reel to the first buffer station by laterally moving the first unpacked reel directly from the unpack station to the first buffer station;

d) providing a second packed reel to the unpack station;

e) unpacking the second packed reel at the unpack station;

f) transferring the first unpacked reel from the first buffer station to the reel splicer, and g) feeding the first unpacked reel to the reel splicer.

18. The method according to claim 17 wherein the step of transferring the first unpacked reel from the first buffer station to the splicer is executed while the step of unpacking the second packed reel at the unpack station is executed.

* * * * *